US010265765B2

(12) United States Patent
Rodge

(10) Patent No.: US 10,265,765 B2
(45) Date of Patent: Apr. 23, 2019

(54) TEMPERATURE CONTROLLED CASTING PROCESS

(71) Applicant: KWS South Wales Limited, Swansea (GB)

(72) Inventor: Alun Rodge, Malpas (GB)

(73) Assignee: KWS South Wales Limited, Swansea (GB)

( * ) Notice: Subject to any disclaimer, the term of this patent is extended or adjusted under 35 U.S.C. 154(b) by 0 days.

(21) Appl. No.: 15/365,481

(22) Filed: Nov. 30, 2016

(65) Prior Publication Data

US 2017/0157669 A1 Jun. 8, 2017

(30) Foreign Application Priority Data

Dec. 2, 2015 (GB) ..... 1521213.7
Apr. 27, 2016 (GB) ..... 1607352.0

(51) Int. Cl.

| | |
|---|---|
| ***B22D 37/00*** | (2006.01) |
| ***B22D 39/00*** | (2006.01) |
| ***B22C 9/00*** | (2006.01) |
| ***B22D 17/30*** | (2006.01) |
| ***B22D 19/00*** | (2006.01) |
| ***B22D 46/00*** | (2006.01) |
| *B22C 9/02* | (2006.01) |
| *B22D 17/00* | (2006.01) |

(52) U.S. Cl.

CPC ..... *B22D 37/00* (2013.01); *B22C 9/00* (2013.01); *B22D 17/30* (2013.01); *B22D 19/00* (2013.01); *B22D 39/00* (2013.01); *B22D 46/00* (2013.01); *B22C 9/02* (2013.01); *B22D 17/00* (2013.01)

(58) Field of Classification Search

CPC ..... B22D 37/00; B22D 39/00; B22D 46/00; B22D 17/00; B22D 17/30; B22C 9/00; B22C 9/02

USPC ..... 164/457, 133

See application file for complete search history.

(56) References Cited

U.S. PATENT DOCUMENTS 3,575,230 A * 4/1971 Calderon ..... B22D 11/0455 164/338.1
3,991,808 A * 11/1976 Nieman et al. ..... B22D 1/007 164/155.6
5,447,188 A 9/1995 Srostlik et al.
2010/0282427 A1* 11/2010 Jacques et al. ..... B22D 11/007 164/4.1

(Continued)

FOREIGN PATENT DOCUMENTS

DE 102005022479 B3 12/2006
GB 2492101 A 12/2012

(Continued)

OTHER PUBLICATIONS

Combined Search and Examination Report dated May 19, 2016 as received in GB Application No. GB1607352.0.

(Continued)

*Primary Examiner* — Kevin P Kerns
(74) *Attorney, Agent, or Firm* — Morris & Kamlay LLP

(57) ABSTRACT

A method of casting is provided, wherein a molten material is introduced into a mould such that the molten material flows out of the mould, wherein once a desired temperature of the mould is achieved, the molten material is prevented from flowing out of the mould such that the molten material at least partially fills the mould.

14 Claims, 5 Drawing Sheets

(56) References Cited

U.S. PATENT DOCUMENTS

2014/0190651 A1 7/2014 Shergold

FOREIGN PATENT DOCUMENTS

| | | | |
|---|---|---|---|
| JP | H06304735 | A | 11/1994 |
| JP | H08174178 | A | 7/1996 |
| JP | 3389449 | B2 | 3/2003 |
| WO | WO-2016011503 | A1 | 1/2016 |

OTHER PUBLICATIONS

European Search Report dated Apr. 11, 2017 as received in Application No. 16200994.
Office Action dated Sep. 8, 2016 as received in GB Application No. GB15212I3.7.
Search Report dated Feb. 16, 2016 as received in Application No. GB1521213.7.

* cited by examiner

TEMPERATURE CONTROLLED CASTING PROCESS

FIELD OF THE INVENTION

The present invention relates to a temperature-controlled method of casting.

BACKGROUND OF THE INVENTION

There are many different types of casting known in the art. However, a common aspect of many casting processes is the need to achieve certain temperature thresholds within the mould. These temperatures need to be achieved accurately, as the material properties of the cast substance are highly sensitive to even slight variations in casting temperature and duration. These considerations are vitally important for creating particular material properties in single material casts, and for optimizing the physical and chemical bonding of dissimilar materials in alloys.

Presently, to achieve the desired mould temperatures, it is known in the art to heat moulds by a number of different methods, including by introducing hot gas, water or oil into the mould before casting, by infra-red heating, by electrical probes inserted into the mould, and by placing the mould in a dedicated preheating oven from which it is removed before casting. Further, it is also common in the art to use any of the above preheating methods to crudely reach an approximate temperature domain, and to then begin the casting process accepting that at least the first few castings will produce poor quality scrap due to suboptimal mould temperature and/or uneven mould temperature distribution. In this way, the scrap castings are used to further heat the mould to reach the desired mould temperature.

However, these known heating methods suffer from a number of disadvantages, including increased material cost due to scrap wastage, inaccurate temperature heating, and uneven temperature distribution within the mould. Further, these methods are generally not suitable for heating the system at any stage other than at the preheating stage, before casting has begun.

Hence, it would be beneficial in the field if both the temperature of the mould, and the materials within it, could be accurately and efficiently heated at multiple stages of the casting process, and without wasting precious materials.

Further, manufacturers are ever more concerned with the impact that their processes may be having on the environment around them. However, it is crucial that such concerns can be addressed within the context of profitable business. As such, innovations that can simultaneously decrease the adverse effects on the environment, whilst also increasing efficiency, represent vital contributions to the field.

STATEMENT OF THE INVENTION

According to an aspect of the invention, a method of casting is provided wherein a molten material to be cast is flowed into, through and out of a mould. This flow of molten material serves to heat the mould. Subsequently, once the mould temperature reaches a desired temperature, the flow of the molten material out of the mould is stopped, but the molten material continues to flow into the mould, such that the molten material begins to at least partially fill the mould. This method allows the mould to be heated using the same flow of molten material that is to be used to fill the cast and subsequently be casted into the desired object. The molten material that flows out of the mould may be collected in a container, such as a crucible.

The temperature of the mould may be measured to accurately determine when the desired mould temperature is reached. The temperature of the mould may be measured close to or at the interior surface of the interior cavity of the mould. Further, the temperature may be measured by thermocouples or thermostats.

Alternatively, the temperature of the mould can be determined by determining that a predetermined mass and/or volume of the molten material has passed through the mould, that is sufficient to achieve the desired temperature of the mould. The predetermined mass and/or volume of the molten material may be collected in a container, and the container may include a means of measuring that the predetermined mass and/or volume of molten material has been collected within it. Alternatively, the container may be a sump with a fixed volume, designed to be equal to the predetermined volume of molten material that is sufficient for the desired temperature of the mould to be achieved. In this instance, the mould may automatically be filled by the flow of molten material entering the mould due to the backlog of molten material prevented from entering the filled sump.

The flow of the molten material through the system may be controlled using an outlet valve located downstream of the mould, between the exit of the mould and any container. There may also be an inlet valve upstream of the mould, located before the entrance to the mould to further control the flow of molten material through the system when used in combination with the outlet valve. The valves may be used to create different flow rates of the molten material at the entrance and exit of the mould.

The mould may be empty before the molten material enters the mould. Alternatively, the mould may already contain a material that has either previously been cast, or that is prepared within the mould and is ready to be cast with the molten material about to be introduced into the mould.

The mould may further include a retainer for retaining a material within the mould during the introduction of the molten material and the final casting process.

The molten material that flows out of the mould, which may or may not be collected in a container, may be reheated and subsequently reintroduced to the system such that it may once again flow into the mould.

The methods described above may be used in the context of a sand casting, a gravity casting, or a pressure die casting process, or a combination of these. Further, the measurement, control, and operation of any of the above components may be implemented by a computer system that is connected to these components and the casting system as a whole.

BRIEF DESCRIPTION OF THE DRAWINGS

There now follows, by way of example only, a detailed description of preferred embodiments of the present invention, with reference to the figures identified below.

DETAILED DESCRIPTION OF THE EMBODIMENTS

Figure 1:
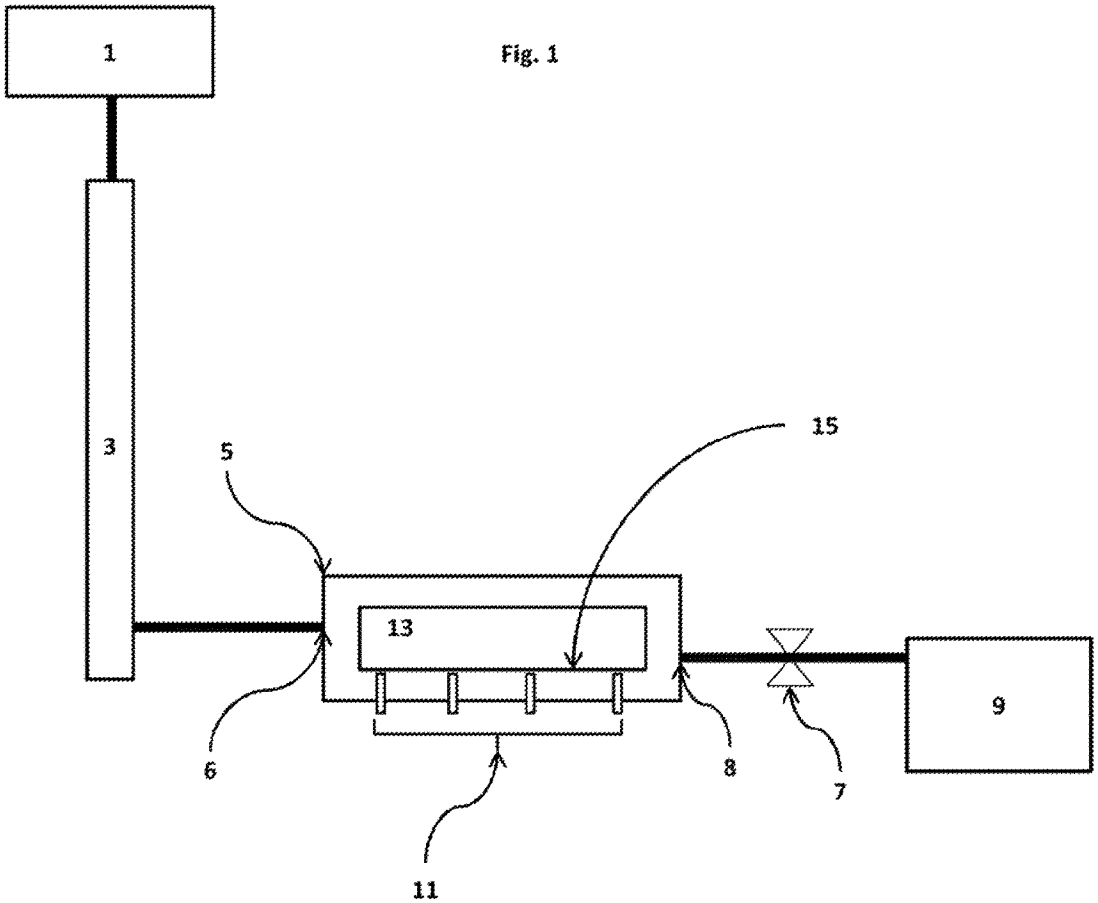
FIG. 1 is a schematic representation of the casting in a first embodiment.

In the following description, functionally similar parts carry the same reference numerals between figures. Preferred embodiments of the invention are now described, by way of example only, with reference to the accompanying drawings.

FIG. 1 illustrates a schematic representation of the heating process in operation. The system has a first crucible 1 that is suitable for containing any molten material, herein referred to as a base material, that is to be cast in the casting process. The base material exits the crucible 1 and is transported via a suitable connection means or conduit to a runner system 3. The runner system 3 allows the base material to enter the mould 5. The general configuration of the mould 5 will be known to the skilled person, and the mould 5 may be any mould suitable for casting base materials. For instance, the mould 5 may be for use in sand casting or gravity casting, but it is not limited thereto. The mould 5 has an internal cavity 13 which is filled by the base material in the casting process. The interior wall of this cavity 13 is called the interface surface 15. In other words, the interface surface 15 is where the material of the mould 5 contacts with the base material when the base material is in the mould 5. Further, the mould 5 has temperature measurement devices 11, such as thermocouples or variable thermostats, located either at or close to the interface surface 15, such that measurement of the temperature of the interface surface 15 may be achieved at any point in the casting process. The temperature measurement devices 11 may be electrically connected to a computer control system, and may be operated by suitable electrical control circuitry.

The mould 5 also has an entrance 6 and an exit 8 that allows the base material to flow from the runner system 3, through the mould 5, and out of the mould 5. The exit 8 to the mould 5 is attached to a suitable connection means or conduit that allows the base material to continue to travel away from the mould 5. The flow of the base material along this exit connection means is controlled by an outlet valve arrangement 7. The outlet valve arrangement 7 is operable to vary the flow of the base material, and is able to provide a continuous or at least variable range of flow rates between its fully closed and fully open states. The outlet valve 7 may be electrically connected to the computer control system, and may be operated by suitable electrical control circuitry. When the outlet valve 7 is in an open state, the base material flows away from the mould 5 through the outlet valve arrangement 7 and into a second crucible 9 able to contain the base material. Hence, through the above arrangement, the base material in the first crucible 1 is able to flow through the system in a controlled manner, based on the state of operation of the outlet valve 7.

In operation, the temperature measurement devices 11 detect the temperature of the interface surface 15. This information may be transmitted to a user by a display, or to the computer control system described earlier. If the temperature of the interface surface 15 as measured by the temperature measurement devices 11 is lower than a desired temperature, any one of the heating processes described below may be implemented. The desired temperature is a variable predetermined quantity, and is dependent on the base materials being used and the desired material properties of the final cast substance.

In each of the below described heating processes, the heating is advantageously achieved using the base material itself, and harnessing the heat energy that has already been used to liquefy the base material. The numerous advantages of this will be described below.

In an embodiment, the mould 5 may be initially empty, and a preheating operation is required. In this instance, preheating is begun by allowing the base material to flow through the system from the first crucible 1, through the runner system 3, and into the mould 5. As the base material enters the mould 5, it flows over the interface surface 15 and transfers heat energy to the interface surface 15 in so doing. The temperature of the interface surface 15 within the mould is continuously measured by the temperature measurement devices 11, and this information is transmitted to the user via a display or to the computer system as described above. During this preheating operation, the outlet valve 7 is in an open state, thereby allowing the base material to flow through and out of the mould 5 towards the second crucible 9, where it is collected. Alternatively, the outlet valve 7 is initially in a closed state, or at least partially closed, so as to allow the mould 5 to fill with the base material, up to a predetermined level. When the predetermined level of base material within the mould 5 is reached, the outlet valve 7 is fully opened to allow the base material to flow through and out of the mould 5 towards the second crucible 9, where it is collected. This alternating process of opening and closing or partially closing the outlet valve 7, thereby alternately filling and emptying the mould 5, advantageously leads to a more uniform distribution of heat within the mould 5.

The base material is allowed to continue flowing through the system in this manner until a desired temperature of the interface surface 15 is measured by the temperature measurement devices 11. At this point the mould 5 is at a suitable temperature for casting the base material flowing through it, and the outlet valve 7 is switched to a closed state. The closing of the outlet valve 7, combined with the continued flowing of the base material from the first crucible 1, causes the mould 5 to begin to fill. Once the mould 5 contains a desired quantity of the base material, either manually or automatically determined, the flow of base material from the first crucible 1 is stopped, and the casting process is begun. The casting process itself may be a conventional casting process, and is not described further herein. The base material present in the second crucible 9 is then returned directly to the first crucible 1 for reuse, or reheated in a conventional manner and subsequently reintroduced to the first crucible 1.

This process has a number of distinct advantages over the known processes in the field. In the first instance, by harnessing the heat energy already within the base material to heat the mould, an efficiency of energy and cost is achieved by avoiding the need to use any of the separate dedicated heating processes known in the art. Further, a second distinct advantage over the prior art is the removal of the need for scrap runs. This beneficially leads to an increase in resource efficiency as wastage of the base material that is inherent to scrap runs has been removed. Indeed, this advantage is particularly dramatic in embodiments of the present invention as there is no wastage of base material at all, as all base material collected in the second crucible 9 is recovered and reused.

These advantages further represent a distinct environmental benefit in the efficient use of energy resources, and in the reduced of wastage of precious base materials.

Further, in embodiments of the present invention, the heating of the mould 5 by means of a flow of the base material is distinctly advantageous over other methods of heating, as the flow of the base material is able to cover all the relevant interface surfaces 15 of the mould 5 that the user is concerned with, thereby leading to an improved uniform heating of the interface surface 15 and overcoming disadvantageous uneven heating that results in poor quality casts. Further, the flow of the base material in particular is distinctly advantageous over the use of other flow based heating methods such as gas, oil or water, as each of these methods may leave deposits within the mould 5 and lead to defects and impurities in the cast substance. Further, these other methods inherently waste the precious natural resources of oil, water and gas etc.

The process of heating the mould 5 as described in the embodiment of the present invention is also particularly advantageous in that it is highly targeted, allowing specific heating of the interface surface 15 of the mould 5 rather than the mould 5 as a whole, as in many known heating techniques. Indeed, the most important area in which to accurately achieve certain temperature thresholds is at the interface between different materials being cast. Hence, the present invention is particularly advantageous in closed mould casting methods, where heating of the interior of the mould can be difficult to accurately achieve. In combination with the specific location of the temperature measurement devices 11 being at or close to the interface surface 15, these features synergistically lead to an increased accuracy in the determination and control of the temperature of the interface surface 15 of the mould 5 during the casting process, and thereby result in an increased quality of cast.

In another embodiment of the invention, the heating of mould 5 as described in the preferred embodiment may be used or repeated at a later stage in a multi-stage casting process. In this instance, the mould 5 may have a layer of alloy material already within it. In such cases, the alloy material already in the mould 5 may be different from the base material to be added to the mould 5. Hence, there may be a second desired temperature within the mould 5 that was different to the original first desired temperature. As the heating of the mould 5 in embodiments of the present invention is achieved using the base material about to be used in the cast, it is advantageously possible to heat the mould 5 at any stage of a casting process, not just during the initial preheating stage as is the case in many conventional heating systems. In such a mid-cast heating process, the flow of the base material is carried out in the same way as described in the above embodiments, with the difference that the temperature measurement devices 11 are at this stage measuring the temperature between the interface surface 15 of the mould 5 and the alloy material already within the mould 5, and as such the measurement of the interface surface temperature between the alloy material and the base material may be inferred from the temperature as measured at the interface surface 15 between the alloy material and the mould 5. The rest of the heating process is carried out as described in the embodiments above.

Figure 2:
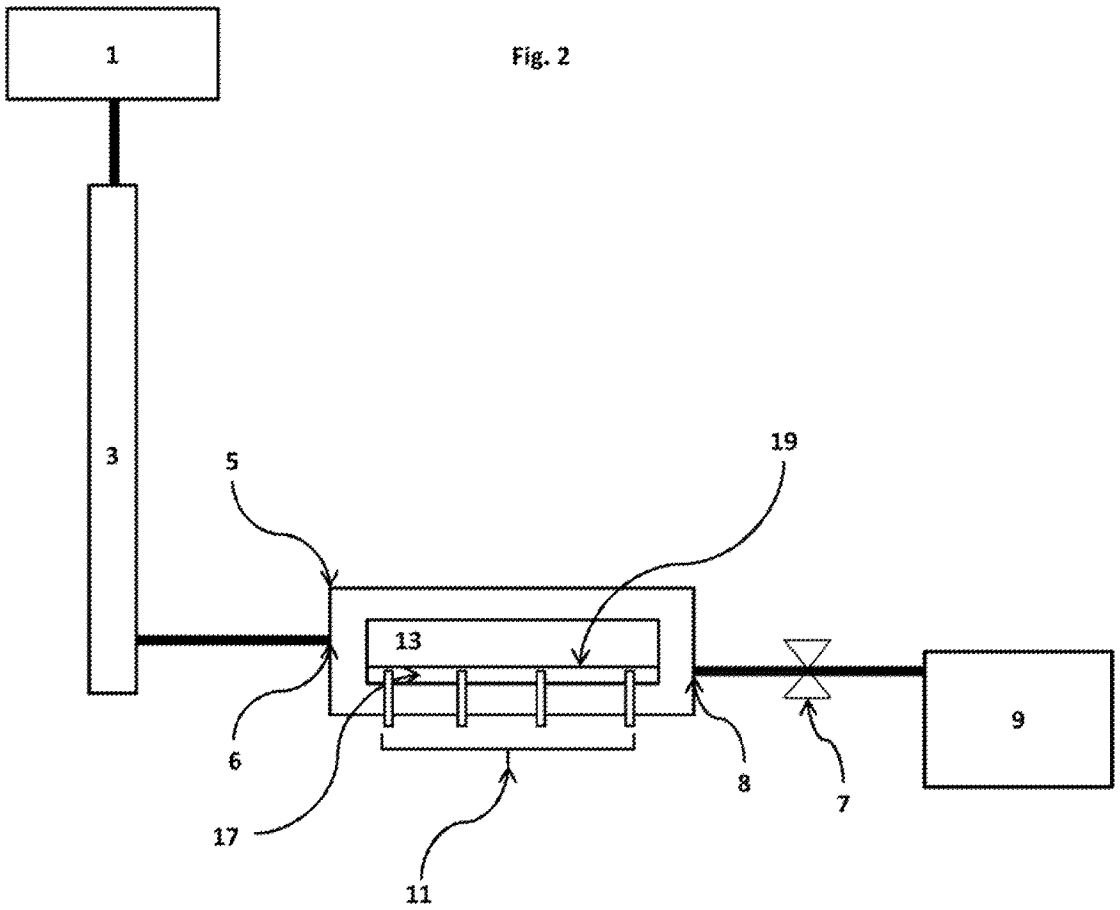
FIG. 2 illustrates a further embodiment of the process of FIG. 1.

FIG. 2 illustrates another embodiment of the invention. In this embodiment, before casting, the mould 5 may be prepared with an alloy material 17 already within it. In this embodiment, the temperature measurement devices 11 may be arranged at or close to the interface surface 19 between the alloy material 17 already within the mould 5 and inner cavity 13 where the base material will be when it enters the mould. In all other respects, the heating process of this embodiment is carried out as described in the above embodiments. Advantageously, these embodiments are therefore able to heat either the interface surface 15 of the mould 5, or the interface surface 19 of the alloy material in the mould 17, in each instance by using the base material about to be cast.

Figure 3:
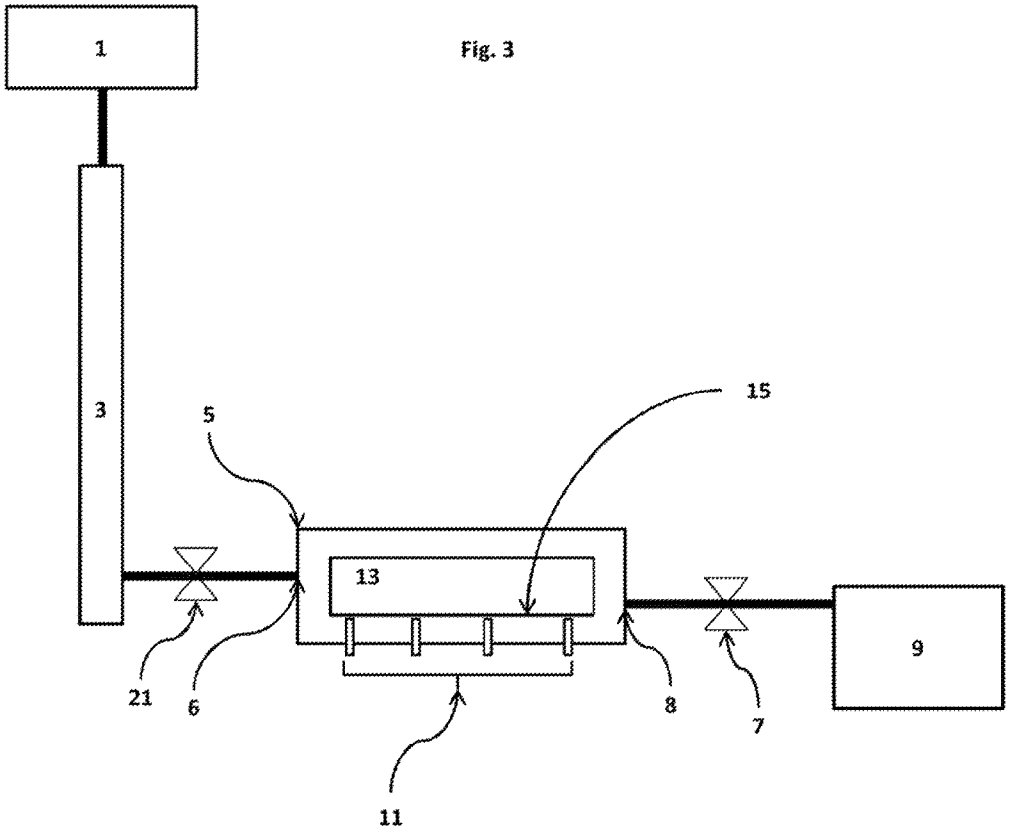
FIG. 3 illustrates another embodiment of the process of FIG. 1.

FIG. 3 illustrates another embodiment of the invention, features of which may be combined with features of any of the embodiments described above. As well as the above described systems, there is also provided an inlet valve 21 located between the runner system 3 and the mould 5. This inlet valve 21 is configured to control the flow of the base material along the connection means before entry to the mould 5. In a similar manner to the outlet valve arrangement 7, the inlet valve 21 is operable to vary the flow of the base material in a manner known to the skilled person, and is able to provide a continuous or at least variable range of flow rates between its fully closed and fully open states. The inlet valve 21 may be electrically connected to the computer control system, and may be operated by suitable electrical control circuitry. When the inlet valve 21 is in an open state, the base material flows into the mould 5. Advantageously, the combination of the inlet valve 21 and the outlet valve 7 allows an improved control of the flow rate of the base material through the system. This is particularly beneficial if an alloy material 17 is already in the mould, as described above, as it is possible to achieve a flow rate of the base material that does not cause such turbulence as to disturb the alloy material 17. Further, it is advantageous in that it allows the mould 5 to be heated in different time periods as a result of different heat transmission characteristics related to varying flow rates of the base material over the interface surfaces 15, 19.

In each of the embodiments described above, the temperature measurement devices 11, the inlet valve 21 and the outlet valve 7 may be electrically connected to a computer control system, and may be operated by suitable electrical control circuitry. Advantageously, this allows improved accuracy in the heating of the system, as the computer system may be configured to electronically operate the outlet valve 7 and/or inlet valve 21, for instance to automatically close the outlet valve 7 once the desired temperature is achieved. Further, it allows automation of the system such that human error can be removed.

In an alternative embodiment of the invention, for certain heating processes such as repeat castings, it may be possible to derive a correlation between the mass and/or volume of collected base material in the second crucible 9, and the temperature at the interface surface within the mould 5. Hence, it is possible to avoid using the temperature measurement devices 11, or to remove them entirely, and to rely solely on the mass and/or volume of base material in the second crucible 9 to determine the temperature of the interface surface 15, 19. Hence, the time at which to close the outlet valve 7 and fill the mould 5 for casting could be determined by measurement of the desired mass and/or volume achieved in the second crucible 9. In a similar manner to features described above, the mass and/or volume measurements of the second crucible 9 may be taken by electronic components connected to the computer control system and the closing of the outlet valve 7 could be automatically achieved. Alternatively, the measurement of mass and/or volume of the base material in the second crucible 9 could be achieved using a mechanical cut-off configuration, thereby mechanically closing off the outlet valve 7 once the required mass and/or volume is achieved. In this embodiment, other variables of the system, including for instance temperature of the base material and flow rate of the base material, should be kept the same as they were under the initial conditions when the correlations were derived.

Further, given the above correlation, it is also be possible to replace the second crucible 9 with a sump of a fixed volume that corresponds to the desired temperature at the interface surface 15, 19. In this instance, the outlet valve 7 could be dispensed with as the flow of base material through the mould 5 would automatically begin to fill the mould 5 once the fixed volume sump was full. Advantageously, this results in a simplified process for repeat casting systems, wherein filling of the mould 5 is automatically achieved once the desired temperature is reached.

Figure 4:
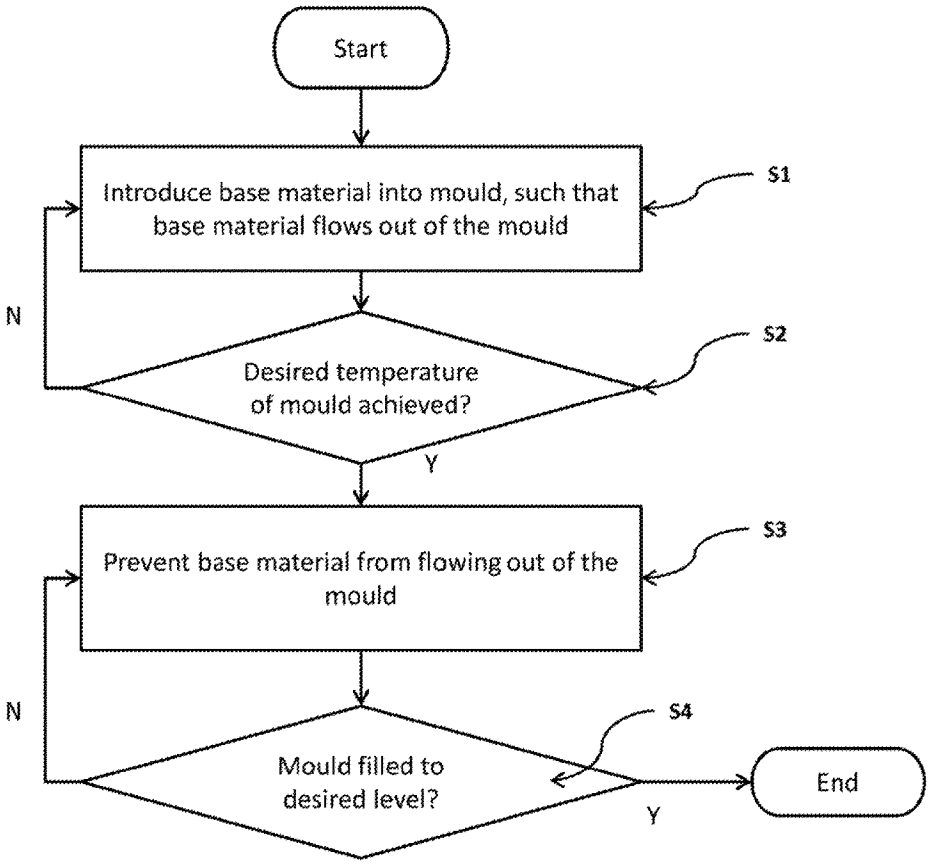
FIG. 4 is a flow diagram illustrating the main process steps of FIG. 1.

FIG. 4 is a flow diagram illustrating the main process steps of FIG. 1. At step S1, the base material is introduced into the mould such that the base material flows through the mould. At step S2, it is determined whether a desired temperature of the mould is achieved. If so, at step S3, the base material is prevented from flowing out of the mould. At step S4, it is determined whether the mould has been filled to the desired level. If so, the process is complete and casting may continue in a conventional manner.

In order to achieve certain material properties in the final cast, for instance strength, lubricity, or resistance to wear et cetera, it is often desirable to use interstitial elements suspended in matrices of the 'parent' base material. In a conventional casting process, this may be achieved by preparing the mould before casting with an interstitial material already within it. However, in the above described heating and casting processes, if a mould is prepared for use with an interstitial material already within it, in certain circumstances the flow of the base material through the mould, either during the heating stage or otherwise, may displace the pre-placed interstitial materials. The turbulence created by the fluid base material as it travels through the system may be sufficient to displace the interstitial material. In other words, the pre-placed interstitial material may be washed out of position or out of the mould entirely by the flow of the base material.

Figure 5:
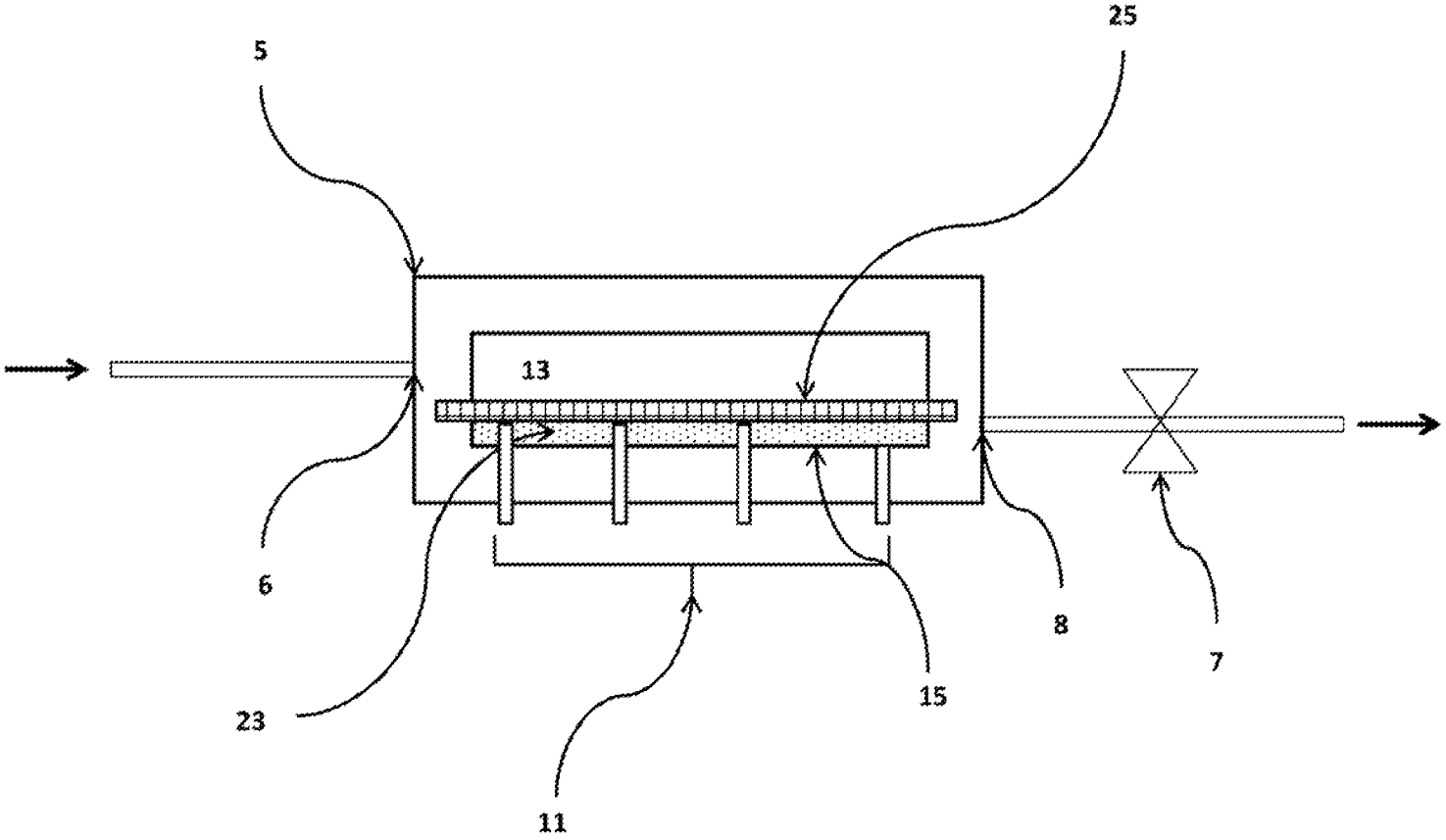
FIG. 5 illustrates a further embodiment of the process of FIG. 1.

FIG. 5 illustrates an embodiment of the invention that addresses this problem. The features of this embodiment may be combined with features of any of the embodiments described above. Before casting, the mould 5 may be prepared with an interstitial material 23, such as tungsten carbide or molybdenum or any other suitable material, already within its inner cavity 13. Instead of leaving the interstitial material 23 exposed, the interstitial material 23 is then covered or otherwise retained by a retainer 25. The retainer 25 may be made of steel or any other suitable material for use within the temperature domains of the casting process. The retainer 25 is then attached to the mould 5 by any suitable means, for instance by means of nails, staples or pins, such that it is able to retain its position within the mould 5 whilst the base material flows through the inner cavity 13 of the mould 5. The retainer 25 may take any suitable form, for instance the retainer 25 may be a mesh, grid or array of wires or bars. The retainer 25 comprises openings to allow the base material to flow through the retainer 25, wherein the openings may take any suitable form, for instance the openings may be gaps, slits, pores or perforations. The dimensions of the retainer 25 openings are chosen to be suitably sized such that the base material may flow freely through the retainer 25, but such that the interstitial material 23 may not pass through the retainer 25. In other words, the openings of the retainer 25 are sized such that the interstitial material 23 is unable to escape through the openings and be washed away, and hence is instead held in position both before and during the heating or casting processes. For instance, when the interstitial material is granular, the openings of the retainer 25 are dimensioned to be smaller than the dimensions of any single grain of the interstitial material 23, thereby preventing movement of the interstitial material 23 through the retainer 25.

In operation, when the base material flows through the mould 5 in a manner as described in any previous embodiment, the base material also flows through the openings of the retainer 25 and through the interstitial material 23. In this way, the base material comes into physical and thermal contact with both the retainer 25 and the interstitial material 23. Advantageously, the retainer 25 maintains the interstitial material 23 in its original location in the mould 5 throughout any of the heating or casting processes as described above.

The interstitial material 23 could be placed anywhere within the inner cavity 13 of the mould 5, as it can be held in position by the retainer 25, and as the base material can flow through both the retainer 25 and the interstitial material 23. Further, there may be a plurality of different sections of interstitial material 23 within the mould 5, each of which is held in a particular location by a respective separate retainer 25.

In order to improve the binding, retention and overall material properties of these interstitial materials in the final cast, it is often desirable to promote a degree of sintering between the interstitial materials and the parent material during the cast process. To achieve this, the interstitial materials must be raised to above their sintering temperature at some time before the casting process is concluded. This sintering process is facilitated by the openings of the retainer 25 which allow the base material to flow through retainer 25 and come into direct physical and thermal contact with the interstitial material 23, thereby transferring heat energy from the base material to at least a part of the interstitial material 23. For instance, at least the boundary areas of the grains of the interstitial material 23 may be exposed to sufficient thermal energy to sinter. Advantageously, the material of the retainer 25 may also be chosen to facilitate this by having a heat transfer characteristic that allows sufficient heat energy to conduct from the base material through the retainer 25 and into the interstitial material 23 to allow sintering of at least a part of the interstitial material 23.

In operation, the interstitial material 23 is initially prepared in the mould 5. The retainer 25 is then located so as to cover the interstitial material 23, and the retainer 25 is then attached to the mould 5 by any suitable means, as described above. The mould 5 is then prepared for preheating and casting. To achieve at least partial sintering of the interstitial material 23, a desired predetermined temperature of the retainer 25 will need to be reached. The requisite heating is achieved using any of the above described preheating or casting methods, in which the base material will flow through the mould 5, through the retainer 25, and through the interstitial material 23, whereby thermal energy will be transferred from the base material to the interstitial material 23, such that sintering of at least the boundary areas of the interstitial material 23 will cause the interstitial material 23 to chemically and/or physically bond to the base material in the final cast.

In particular, any of the above described methods of preheating the mould 5 to a particular temperature may be used, such as opening and closing the valves 7 and 21 to control the base material flow rate, filling the mould 5 to a predetermined level of base material, or collecting a certain amount of base material in a second crucible 9.

To determine the desired temperature of the interstitial material 23 has been achieved, for instance to achieve sintering of the interstitial material 23, the temperature measurement devices 11 are located in the interstitial material 23 as shown in FIG. 5. Alternatively, the temperature measurement devices 11 may be arranged to be located at or close to the interface surface 15 between the inner cavity 13 of the mould 5 and the interstitial material 23, in which case the temperature of the interstitial material 23 as a whole may be inferred from the temperature as measured at this location.

The information received by the temperature measurement devices 11 may be transmitted to a user by a display, or to the computer control system, both as described earlier. If the temperature of the interstitial material 23 as measured by the temperature measurement devices 11 is lower than a desired temperature, any one of the heating processes described above may be implemented.

In all other respects, the heating process of this embodiment is carried out as described in the above embodiments. Hence, the base material is allowed to continue flowing through the system, flowing in through the retainer 25, and through the interstitial material 23, until a desired temperature of the interstitial material 23 is measured by the temperature measurement devices 11. At this point the mould 5 is at a suitable temperature for casting the base material flowing through it, and the outlet valve 7 is switched to a closed state, and the mould 5 fills with base material as described in previous embodiments.

As further described in previous embodiments, a multistage casting process may also be applied, wherein two separate desired temperatures are to be achieved at different stages of the cast. This may be carried out as described in previous embodiments above.

Once the casting process has been completed, the finished cast including the interstitial material 23 and the retainer 25 may be removed from the mould 5 as in conventional casting processes. As a result of the sintering facilitated by the retainer 25, the resulting cast comprises the base material, the retainer 25, at least a portion of partially sintered interstitial material 23, and the remaining interstitial material 23. Hence, using the retainer 25 as herein described, it is possible to create a final cast including interstitial materials for improved material properties, even within the context of the previously described heating and casting processes. Advantageously, as the retainer 25 is present in the final cast, it also serves to provide extra reinforcement to the final cast.

Advantageously, the retainer as herein described provides the possibility of using interstitial materials in casts created using the above-described heating processes, wherein the retainer is simultaneously able to retain the interstitial material in its required location during heating or casting, whilst also facilitating the desired level of sintering of the interstitial materials in the process.

Any of the above described embodiments may be controlled and operated by a computer system (not described here), so that the each of the components, measurements and operations described above may be controlled by suitable electrical control circuitry connected to the computer system.

ALTERNATIVE EMBODIMENTS

The embodiments described above are illustrative of, rather than limiting to, the present invention. Alternative embodiments apparent on reading the above description may nevertheless fall within the scope of the invention.

The invention claimed is:

1. A method of casting, comprising:

a. providing a mould containing an interstitial material for inclusion in a cast;

b. providing a retainer within the mould;

c. heating a mould to a predetermined temperature by introducing a molten material for casting into the mould such that the molten material flows through and out of the mould, wherein the retainer retains the interstitial material in a location within the mould; and d. subsequently determining that the predetermined temperature of the mould is achieved and in response preventing the molten material from flowing out of the mould such that the molten material at least partially fills the mould.

2. The method of claim 1, wherein determining that the predetermined temperature of the mould is achieved comprises measuring a temperature of the mould.

3. The method of claim 2, wherein the temperature of the mould is measured in the proximity of a surface within the mould.

4. The method of claim 1, wherein the molten material that flows out of the mould is collected in a container.

5. The method of claim 1, wherein determining that the predetermined temperature of the mould is achieved comprises determining that a predetermined mass and/or volume of the molten material has flowed out of the mould.

6. The method of claim 5, wherein the molten material that flows out of the mould is collected in a container.

7. The method of claim 6, wherein the container is a sump of a fixed volume, wherein when the sump is filled with molten material, the molten material in the mould is prevented from flowing out of the mould.

8. The method of claim 6, wherein a predetermined mass and/or volume of the molten material in the container is measured so as to determine that the predetermined temperature of the mould is achieved.

9. The method of claim 1, further comprising controlling the flow of the molten material using a valve downstream or upstream of the mould.

10. The method of claim 1, further comprising controlling the flow of the molten material using a valve upstream of the mould.

11. The method of claim 1, wherein when the molten material is introduced into the mould, heat energy is conducted from the molten material to the interstitial material.

12. The method of claim 1, wherein the predetermined temperature is a temperature sufficient to cause sintering of at least a part of the interstitial material.

13. The method of claim 1, wherein the retainer comprises openings, wherein the openings are dimensioned so as to prevent the transport of the interstitial material through the openings, but so as to allow the transport of molten material through the openings.

14. The method of claim 1, wherein the molten material that flows out of the mould is reheated and then reintroduced to the mould.

* * * * *